US009297118B2

(12) United States Patent
Li et al.

(10) Patent No.: US 9,297,118 B2
(45) Date of Patent: Mar. 29, 2016

(54) SUPERAMPHIPHOBIC PAPER

(71) Applicants: Lester Li, Atlanta, GA (US); Victor Breedveld, Atlanta, GA (US); Dennis Hess, Atlanta, GA (US)

(72) Inventors: Lester Li, Atlanta, GA (US); Victor Breedveld, Atlanta, GA (US); Dennis Hess, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 71 days.

(21) Appl. No.: 14/298,193

(22) Filed: Jun. 6, 2014

(65) Prior Publication Data

US 2014/0360689 A1 Dec. 11, 2014

Related U.S. Application Data

(60) Provisional application No. 61/832,304, filed on Jun. 7, 2013.

(51) Int. Cl.

| | |
|---|---|
| ***D21H 21/16*** | (2006.01) |
| ***D21H 15/02*** | (2006.01) |
| ***D21H 25/04*** | (2006.01) |

(52) U.S. Cl.

CPC ..... *D21H 21/16* (2013.01); *D21H 15/02* (2013.01); *D21H 25/04* (2013.01)

(58) Field of Classification Search

USPC ..... 162/158, 164.1; 427/569

See application file for complete search history.

(56) References Cited

U.S. PATENT DOCUMENTS

| | | | | |
|---|---|---|---|---|
| 5,324,566 | A | 6/1994 | Ogawa et al. | |
| 5,328,576 | A * | 7/1994 | Paskalov | B29C 59/14 204/164 |
| 2003/0136518 | A1 | 7/2003 | Shanov et al. | |
| 2010/0172799 | A1 | 7/2010 | Roeper et al. | |
| 2011/0286896 | A1 | 11/2011 | Hess et al. | |

* cited by examiner

*Primary Examiner* — Dennis Cordray

(74) *Attorney, Agent, or Firm* — Bryan W. Bockhop; Bockhop & Associates, LLC

(57) ABSTRACT

In a method of making a superamphiphobic paper, a fibrous pulp is refined in water to generate fibrils of an average diameter. The water is drained from the fibrils through a mesh. A less polar than water liquid is added to the fibrils, thereby suspending the fibrils therein so as to inhibit agglomeration between the fibrils. The less polar than water liquid and any remaining water are drained from the fibrils. The fibrils are pressed and dried so as to form the paper in which the fibrils have an average spacing. Amorphous phase cellulose is removed from the paper. A predetermined compound is deposited onto a selected surface of the paper. The average diameter and average spacing are chosen so that the paper is phobic to the first liquid.

15 Claims, 2 Drawing Sheets

SUPERAMPHIPHOBIC PAPER

CROSS-REFERENCE TO RELATED APPLICATION(S)

This application claims the benefit of U.S. Provisional Patent Application Ser. No. 61/832,304, filed Jun. 7, 2013, the entirety of which is hereby incorporated herein by reference.

BACKGROUND OF THE INVENTION

1. Field of the Invention

The present invention relates to paper and, more specifically, to a superamphiphobic paper.

2. Description of the Related Art

Common cellulosic paper is made from wood fibers that have been dried from a suspension in water and then pressed into a flat sheet. Typical paper (e.g., newsprint, writing paper and the like) is both hydrophilic (readily absorbs water) and oleophilic (readily absorbs oils).

In certain applications it is desirable to make paper either hydrophobic (not absorbing water), oleophobic (not absorbing oil), or both. Typically, paper is coated with layers of waxes or polymers to make it have these properties. However, such coatings can degrade over time when in contact with certain substances. Also, such coatings can introduce certain undesirable properties to the papers.

In diagnostic applications, such as biochemical assay applications, a superamphiphobic sheet (in which a drop of liquid has an apparent contact angle of greater than 150° on the sheet) can be useful. For example, a superamphiphobic sheet with a region of functionalized molecules printed thereon could be used to detect the presence of certain antibodies in blood samples or components in other bodily fluid samples to indicate the presence of a disease. The functionalized molecules would attach to the antibodies as the blood sample rolled off of the paper and a resulting change in appearance would indicate the presence of the target antibody.

In certain special applications, super-hydrophobic surfaces and super-oleophobic surfaces can be made by adding an array of nail head-shaped nanostructures onto a substrate through complex lithographic processes. However, such structures require special materials and making such structures can be cost prohibitive. Such sheets and structures are also quite rigid and fragile.

Paper, on the other hand, is made from inexpensive wood pulp. Therefore, many papers can be made quite inexpensively. Paper is also quite flexible and strong.

Therefore, there is a need for a superamphiphobic paper and a method of making superamphiphobic paper.

SUMMARY OF THE INVENTION

The disadvantages of the prior art are overcome by the present invention which, in one aspect, is a method of making a paper that is phobic at least to a first liquid, in which a fibrous pulp is refined in water to generate fibrils of an average diameter. The water is drained from the fibrils through a mesh. A less polar than water liquid is added to the fibrils, thereby suspending the fibrils therein so as to inhibit agglomeration between the fibrils. The less polar than water liquid and any remaining water are drained from the fibrils. The fibrils are pressed and dried so as to form the paper in which the fibrils have an average spacing. Amorphous phase cellulose is removed from the paper. A predetermined compound is deposited onto a selected surface of the paper. The average diameter and average spacing are chosen so that the paper is phobic to the first liquid.

In another aspect, the invention is a superamphiphobic paper that includes a plurality of fibrils and a surface treatment. The plurality of fibrils has an average diameter and an average spacing selected so as to make the paper phobic to a low surface tension liquid. The surface treatment is applied to the paper and is configured to cause the paper to be phobic to the low surface tension liquid and phobic to a high surface tension liquid that is different from the low surface tension liquid.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
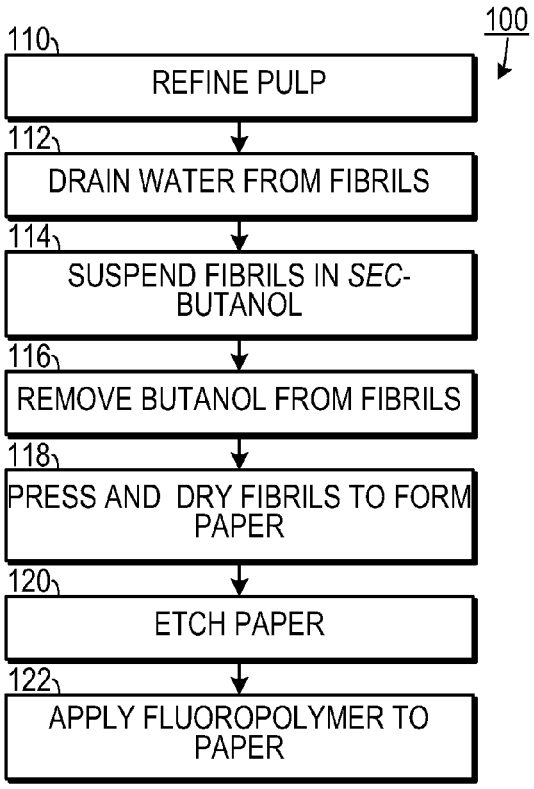
FIG. 1 is a flow chart showing one method of making a paper.

A preferred embodiment of the invention is now described in detail. Referring to the drawings, like numbers indicate like parts throughout the views. Unless otherwise specifically indicated in the disclosure that follows, the drawings are not necessarily drawn to scale. As used in the description herein and throughout the claims, the following terms take the meanings explicitly associated herein, unless the context clearly dictates otherwise: the meaning of "a," "an," and "the" includes plural reference, the meaning of "in" includes "in" and "on."

As shown in FIG. 1, in one method of making a superamphiphobic paper 100, wood pulp is refined 110 in water in a conventional grinding process known to the paper making arts to separate fibrils, which are suspended in the water. The water is drained from the suspension using a mesh 112 and then a butanol isomer (such as sec-butanol) is added to the fibrils 114. (Other liquids that are less polar than water may also be used in certain applications.) The sec-butanol, being a less polar than water liquid, prevents the fibrils from agglomerating due to hydrogen bonding and, thus, when the butanol is removed from the fibrils 116 the fibrils tend to remain separated from each other and be evenly dispersed. Once dry, the fibrils are pressed 118 so as to form a paper. The paper is etched 120 (such as with an oxygen plasma etch) for a predetermined amount of time to remove amorphous cellulose from the surface of the paper in order to roughen the fibril surface. A compound, such as a fluoropolymer (originating, for example, from a pentafluoroethane precursor), is then applied to the surface of the paper 122.

The paper can be made phobic, and even superphobic, to different liquids by selecting the average diameter of the fibrils, the average distance between fibrils, the surface coating compound and the time spent etching.

Figure 2:
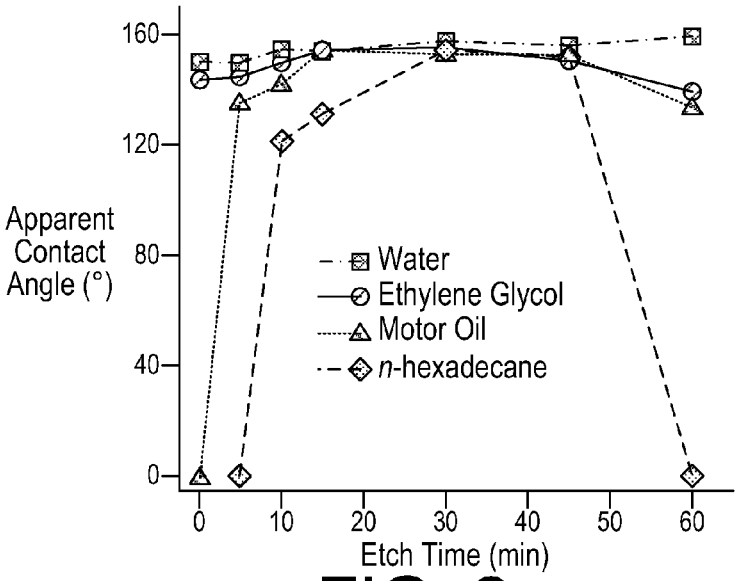
FIG. 2 is a graph relating apparent contact angles of various fluids on paper to etch time.

As shown in FIG. 2, an etching time of between 10 minutes and 50 minutes can result in paper being made phobic to a range of liquids (including water, ethylene glycol, motor oil and n-hexadecane). (As used herein, paper is "phobic" when a drop of liquid has a contact angle on the paper of at least 90° and it is "super-phobic" when the drop has a contact angle of at least 150°). When the etching step is performed for a period of between 30 minutes and 45 minutes, paper becomes superphobic to these liquids. Since water has a very high surface tension and n-hexadecane has a very low surface tension, with the surface tensions of the ethylene glycol and motor oil falling between the two, paper etched in the 30-45 minute range are superamphiphobic.

Attainment of superoleophobicity relies heavily on distinct roughness geometries of the paper. Specifically, the contact angles of low surface tension fluids are enhanced by surface structures with reentrant angles. The bottom half of a cylindrical fiber offers reentrant angles or overhang constructs that are similar to lithographically created structures. The critical physical parameters of superoleophobic substrates are the dimensions and spacing of the structures.

Figure 3:
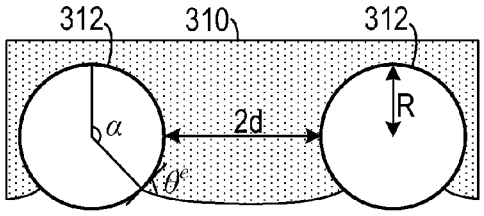
FIG. 3 is a schematic diagram showing relevant parameters relative to two ideal fibrils.

As shown in FIG. 3, a useful model used to describe wetting behavior on roughened surfaces employs two spaced apart fibers 312 that are subject to a liquid droplet 310. In this model, the liquid is assumed to be in complete contact with the enhanced surface area generated by roughness. The liquid droplet 310 is supported by air pockets trapped between the surface structures, thereby reducing the liquid-solid contact area. To model fiber-based substrates, the following equation describes the relation between the relevant parameters:

$$\cos\theta^* = \frac{D(\pi - \theta^e)}{L}\cos\theta^e + \frac{D}{L}\sin\theta^e - 1$$

where the apparent contact angle ($\theta^*$) is a function of the center-to-center distance between two fibers (L), the fiber diameter (D=2R), and equilibrium contact angle ($\theta^e$). The size and spacing of surface structures can easily be varied when produced lithographically, whereas for fiber-based mesh screens and woven fabrics, L and D are established by the manufacturing process, fiber size, and weave.

In one experimental embodiment, a superamphiphobic paper was made using southern hardwood Kraft fibers (from Alabama River Pulp Co.). The fibers were refined according to the TAPPI standardized method T 248 sp-08 whereby dry fiber sheets were soaked in deionized water overnight and then loaded in a PFI (Pulp and Fiber Research Institute) refiner (from Test Machines Inc.) and exposed to different levels of refining as defined by the number of revolutions.

Handsheets (small test sheets of paper) were formed made using sec-butanol (from Alfa Aesar, anhydrous, 99%), the refined pulp was first drained through a 75 μm pore mesh screen. The water filtrate was discarded and sec-butanol (100 mL) is added to the drained pulp. The pulp was then remixed for 2 minutes and again drained through a 75 μm screen. After the sec-butanol/water mixture has drained from the pulp, the sheet was pressed and then dried overnight on a stainless steel plate.

The paper samples were etched and subsequently exposed to fluorocarbon film deposition in a parallel plate (13.56 MHz) vacuum plasma reactor. Both steps were conducted at 110° C. using a power of 120 W. To etch the paper, oxygen was introduced to the reactor at 75 standard cubic centimeters per minute (SCCM), and allowed to reach an equilibrium pressure of $5.0\times10^{-1}$ Torr. The fluoropolymer coating was deposited using a plasma composed of 40 SCCM Ar and 20 SCCM pentafluoroethane (Praxair) at an operating pressure of 1.0 Torr. While etch times were varied, the deposition step was constant at 2 minutes, yielding a coating thickness of about 400 nm.

Figure 4A:
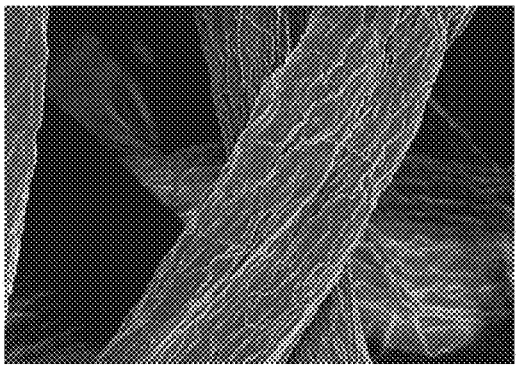
FIG. 4A is a micrograph of unrefined cellulosic fibers.
Figure 4B:
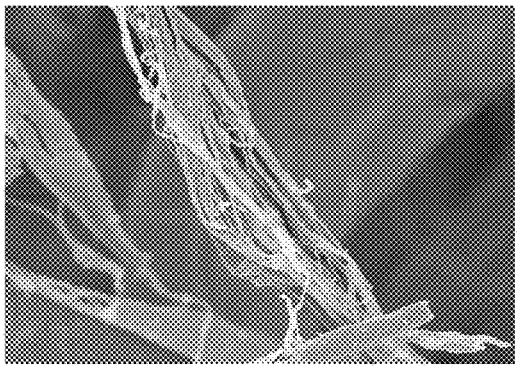
FIG. 4B is a micrograph of refined cellulosic fibrils.
Figure 5A:
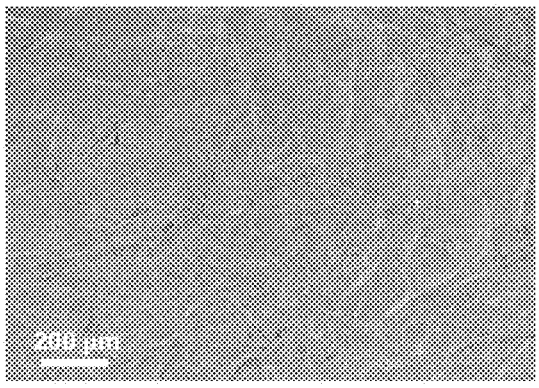
FIG. 5A is a micrograph of cellulosic fibrils that were dried from a water only suspension.
Figure 5B:
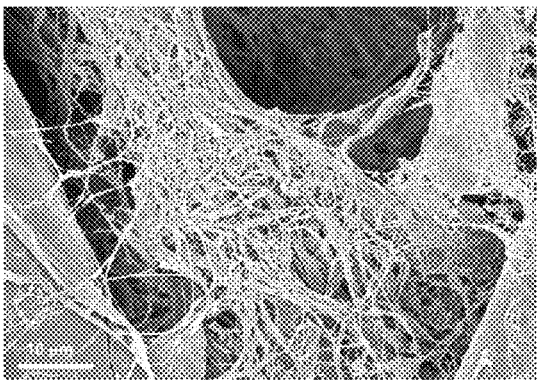
FIG. 5B is a micrograph of cellulosic fibrils that were dried from a butanol suspension.

A micrograph of unrefined wood fibers is shown in FIG. 4A and a micrograph of fibrils resulting from refinement is shown in FIG. 4B. Agglomerated fibrils resulting from drying the fibrils only in water are shown in the micrograph in FIG. 5A and non-agglomerated fibrils resulting from drying the fibrils in sec-butanol are shown in FIG. 5B.

The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A method of making a paper that is phobic at least to a first liquid, comprising the steps of:

(a) refining a fibrous pulp in water to generate fibrils of an average diameter;

(b) draining the water from the fibrils through a mesh;

(c) adding a less polar than water liquid to the fibrils and suspending the fibrils therein so as to inhibit agglomeration between the fibrils;

(d) draining the less polar than water liquid and any remaining water from the fibrils;

(e) pressing and drying the fibrils so as to form the paper in which the fibrils have an average spacing;

(f) removing amorphous phase cellulose from the paper; and (g) depositing a predetermined compound onto a selected surface of the paper, wherein the average diameter and average spacing are chosen so that the paper is phobic to the first liquid.

2. The method of claim 1, wherein the average diameter and the average spacing are chosen so that the paper is phobic to at least one organic liquid.

3. The method of claim 1, wherein the less polar than water liquid comprises a butanol isomer.

4. The method of claim 1, wherein the fibers comprise cellulosic fibers.

5. The method of claim 1, wherein the step of removing amorphous phase cellulose comprises etching the paper.

6. The method of claim 5, wherein the etching step comprises the step of subjecting the paper to an oxygen plasma.

7. The method of claim 5, wherein the etching step is performed for a period of between 10 minutes and 50 minutes.

8. The method of claim 5, wherein the etching step is performed for a period of between 30 minutes and 45 minutes, thereby making the paper superamphiphobic.

9. The method of claim 1, wherein the first liquid has an apparent contact angle on the paper of at least 120°.

10. The method of claim 1, wherein the first liquid has an apparent contact angle on the paper of at least 150°.

11. The method of claim 1, wherein the predetermined compound is chosen so that the paper becomes phobic to the first liquid and phobic to a second liquid, different from the first liquid.

12. The method of claim 11, wherein the second liquid has an apparent contact angle on the paper of at least 120°.

13. The method of claim 11, wherein the second liquid has an apparent contact angle on the paper of at least 150°.

14. The method of claim 11, wherein the predetermined compound comprises a fluoropolymer and wherein the second liquid comprises water.

15. The method of claim 14, wherein the fluoropolymer originates from a pentafluoroethane precursor.

* * * * *